US009302487B2

(12) United States Patent
Ohnishi

(10) Patent No.: US 9,302,487 B2
(45) Date of Patent: Apr. 5, 2016

(54) LIQUID SUPPLY DEVICE, INK JET RECORDING DEVICE, AND LIQUID SUPPLY METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/425,054

(22) PCT Filed: Sep. 6, 2013

(86) PCT No.: PCT/JP2013/074140
§ 371 (c)(1),
(2) Date: Mar. 2, 2015

(87) PCT Pub. No.: WO2014/038673
PCT Pub. Date: Mar. 13, 2014

(65) Prior Publication Data

US 2015/0202882 A1 Jul. 23, 2015

(30) Foreign Application Priority Data

Sep. 7, 2012 (JP) ..... 2012-197883
Mar. 8, 2013 (JP) ..... 2013-047372

(51) Int. Cl.
*B41J 2/175* (2006.01)

(52) U.S. Cl.
CPC ..... *B41J 2/17566* (2013.01); *B41J 2/17509* (2013.01); *B41J 2/17513* (2013.01); *B41J 2/17523* (2013.01); *B41J 2/17556* (2013.01)

(58) Field of Classification Search
CPC .. B41J 2/1755; B41J 2/17513; B41J 2/17523; B41J 2/17553
USPC ..... 347/7, 85, 86; 141/2, 18
See application file for complete search history.

(56) References Cited

U.S. PATENT DOCUMENTS

| | | | | |
|---|---|---|---|---|
| 6,048,054 | A * | 4/2000 | Ando et al. | 347/85 |
| 6,702,427 | B2 * | 3/2004 | Shimizu et al. | 347/50 |
| 6,883,905 | B2 * | 4/2005 | Kimura et al. | 347/85 |
| 7,547,097 | B2 * | 6/2009 | Tsukada et al. | 347/85 |
| 8,205,973 | B2 * | 6/2012 | Nitta et al. | 347/85 |

FOREIGN PATENT DOCUMENTS

| | | |
|---|---|---|
| JP | 2003-341029 | 12/2003 |
| JP | 2005-103758 | 4/2005 |
| JP | 2005-319655 | 11/2005 |

OTHER PUBLICATIONS

"International Search Report (Form PCT/ISA/210)", mailed on Oct. 1, 2013, with English translation thereof, pp. 1-2, in which two of the listed references (JP2005-103758 and JP2003-341029) were cited.

* cited by examiner

*Primary Examiner* — Anh T Vo
(74) *Attorney, Agent, or Firm* — Jiang Chyun Intellectual Property Office

(57) ABSTRACT

There is provided an ink jet device capable of adjusting supply pressure of liquid to a recording head in which a fluctuation in the supply pressure of liquid caused by liquid consumption on a recording head is repressed in a simple constitution. The ink jet device includes a main tank 2, a sub tank 6 for receiving liquid from the main tank 2 and storing the liquid, and a supply unit for supplying the liquid stored in the sub tank 6 to the recording head 11, the supply unit adjusts a height of the sub tank, and the sub tank 6 has a ventilation opening 12.

9 Claims, 5 Drawing Sheets

LIQUID SUPPLY DEVICE, INK JET RECORDING DEVICE, AND LIQUID SUPPLY METHOD

CROSS-REFERENCE TO RELATED APPLICATION

This application is a 371 application of the International PCT application serial. no. PCT/JP2013/074140, filed on Sep. 6, 2013, which claims priority benefits of Japan patent application no. 2012-197883, filed on Sep. 7, 2012, and Japan patent application no. 2013-047372, filed on Mar. 8, 2013. The entirety of each of the above-mentioned patent applications is hereby incorporated by references herein and made a part of this specification.

TECHNICAL FIELD

The present invention relates to a liquid supply device, an ink jet recording device, and a liquid supply method.

BACKGROUND ART

In an ink jet recording device for adjusting supply pressure of ink to a recording head according to a water head difference, when an ink liquid surface in an ink tank fluctuates according to ink consumption, ink supply pressure also fluctuates accordingly. Particularly in industrial ink jet recording devices in which continuous duty is required, such a fluctuation in the ink supply pressure caused by ink consumption is not desirable. Therefore, in ink jet recording devices that can adjust supply pressure of liquid to recording heads, technique for repressing a fluctuation in the ink supply pressure caused by ink consumption is required.

Patent Document 1 describes an ink jet recording device in which a back pressure tank which is connected to a recording head and whose liquid level is kept constant by supplying ink from a main tank according to ink consumption is provided between the recording head and the main tank in the ink jet recording device, and a position of the back pressure tank is adjusted in a height direction so that a position water head of the liquid level of the back pressure tank with respect to the recording head is adjustable.

PRIOR ART DOCUMENT

Patent Document

Patent Document 1: JP 2005-319655 A (disclosed on Nov. 17, 2005)

SUMMARY OF THE INVENTION

Problems to be Solved by the Invention

The technique described in Patent Document 1 can supply ink from a main tank according to the consumption of ink in a back pressure tank so as to keep a liquid level constant. However, the technique described in Patent Document 1 requires a liquid level detector for detecting the height of the liquid level, an ink supply pump for supplying a suitable amount of ink from the main tank to the back pressure tank based on detected value of the liquid level detector, and a control device for the ink supply pump. For this reason, the mechanism becomes complicated, and when a defect occurs in the liquid level detector or the like, the ink is not suitably supplied from main tank to the back pressure tank. Further, it is not desirable from an aspect of the cost of the ink jet recording device to provide an expensive liquid level detector and control device.

The present invention is devised from a viewpoint of the above problem, and its object is to provide a technique that represses a fluctuation in liquid supply pressure caused by liquid consumption on a recording head in a simple constitution in an ink jet device that can adjust supply pressure of liquid to the recording head.

Solution to the Problems

A liquid supply device of the present invention includes a main tank for storing liquid to be discharged from a recording head, a supply pipe communicated with the main tank, a sub tank for receiving liquid from the main tank by a water head difference via the supply pipe and storing the liquid, and a supply unit for supplying the liquid stored in the sub tank to the recording head, wherein the supply unit has a driving unit for adjusting a height of the sub tank in a vertical direction, the sub tank has a ventilation opening, and the supply pipe has a first opening section opened at a predetermined height lower than the ventilation opening in the vertical direction.

According to the above constitution, the supply pipe introduces gas into the main tank and simultaneously supplies the gas to the sub tank. When the liquid level of the liquid reaches the first opening section in the sub tank, the first opening section is blocked by the liquid, and the introduction of the gas is stopped. At the same time, the supply of liquid to the main tank is also stopped. Therefore, the liquid is stably supplied up to the height of the first opening section in the sub tank. That is to say, the liquid is stored in the sub tank so that height of the liquid level is kept constant. As a result, the driving unit adjusts the height of the sub tank in the vertical direction, thereby facilitating adjustment of a water head difference between the sub tank and the recording head. Therefore, the supply pressure of the liquid to the recording head is easily adjusted, and the device can suitably respond to conditions in which a necessary supply amount of liquid is different, like cases of printing and cleaning of the recording head. Further, the liquid supply device of the present invention does not have to have the liquid level detector and the supply pump, and thus the simple, breakdown-resistant and inexpensive device can be provided.

It is preferable that the first opening section of the liquid supply device according to the present invention is provided obliquely with respect to a horizontal surface.

According to the above constitution, air starts to be introduced into the main tank from a higher position on an opening surface of the first opening section in a vertical direction. As a result, on an inside of the supply pipe, the passage into which gas is introduced is stable on a side surface opened on a higher position in the vertical direction. On the contrary, on the inside of the supply pipe, a passage into which liquid is supplied is stable on a side surface opened on a lower position in the vertical direction. Therefore, the side surface of the supply pipe into which gas is introduced and the side surface into which liquid is supplied can be stabilized, and thus exchange of gas and liquid can be performed smoothly.

Further, according to the above constitution, when the liquid level descends near the first opening section, the first opening section that is provided obliquely with respect to the horizontal surface makes an area on the first opening section opened for gas gradually larger, and the amount of supply of liquid into the sub tank gradually increases. This prevents the area on the first opening section opened for gas from being steeply large and prevents a large amount of liquid from being supplied at a time, so that the descending of the liquid level can be smoothly repressed.

In the liquid supply device of the present invention, the supply pipe may include a second opening section for allowing liquid supplied into the sub tank to flow in the main tank, and a third opening section for discharging the gas introduced from the sub tank via the first opening section, the third opening section being provided on a higher position than the second opening section in the vertical direction.

According to the above constitution, the opening section for discharging air and the opening section for allowing liquid to flow in are provided independently in the main tank, so that liquid can be smoothly supplied from the main tank to the sub tank. Further, when the opening section for discharging gas is opened on an upper portion of the main tank, gas is introduced directly into the upper portion of the main tank (a portion where the air is stored), and thus unnecessary dissolving of gas into the liquid in the main tank can be repressed.

In the liquid supply device of the present invention, the supply pipe includes a first pipe for supplying gas from the sub tank into the main tank, and a second pipe for introducing liquid from the main tank into the sub tank, the first pipe is provided with the first opening section and the third opening section, and the second pipe is provided with the second opening section and a fourth opening section opened on a lower position than the first opening section in the vertical direction in the sub tank.

According to the above constitution, the passage for introducing gas and the passage for supplying liquid are provided independently. As a result, liquid can be smoothly supplied from the main tank to the sub tank.

In the liquid supply device of the present invention, the supply pipe may include a third pipe for communicating the first opening section and the third opening section, and the second opening section may be provided on a side surface of the third pipe.

According to the above constitution, the supply pipe can be preferably constituted.

In the liquid supply device of the present invention, the supply unit may have a communication passage for communicating the sub tank and the recording head, and a pressure damper for reducing a pressure fluctuation in liquid flowing through the communication passage, the pressure damper being provided in the communication passage.

According to the above constitution, the pressure damper can adjust the supply pressure of liquid to be supplied from the sub tank to the recording head more suitably. Therefore, a discharge amount of liquid upon printing can be suitably adjusted.

In the liquid supply device of the present invention, at least a part of the supply pipe may have flexibility, and the driving unit may adjust the height of the sub tank in the vertical direction without moving the main tank.

According to the above constitution, since the height of the liquid level in the sub tank is kept constant, only the sub tank is moved so that the supply pressure of liquid can be adjusted. This can make the liquid supply device a more compact constitution.

The ink jet recording device of the present invention is characterized by including the above liquid supply device.

According to the above constitution, in the ink jet device that can adjust the supply pressure of liquid to the recording head, a fluctuation in the supply pressure of liquid caused by liquid consumption on the recording head can be repressed in the simple constitution.

A liquid supply method of the present invention in a liquid supply device including a main tank for storing liquid to be discharged from a recording head, a supply pipe communicated with the main tank and a sub tank having a ventilation opening, wherein the supply pipe having an opening section opened at a predetermined height lower than the ventilation opening in a vertical direction in the sub tank, includes a step of supplying liquid from the main tank via the supply pipe according to a water head difference so as to store the liquid in the sub tank so that a liquid level is at the predetermined height, and a step of the liquid stored in the sub tank to the recording head by adjusting the height of the sub tank in the vertical direction.

The above method produces the effect equivalent to that of the liquid supply device of the present invention.

Effect of the Invention

According to the present invention, in the ink jet device that can adjust the supply pressure of liquid to the recording head, the fluctuation in the supply pressure of liquid caused by liquid consumption on the recording head can be repressed in the simple constitution.

EMBODIMENT OF THE INVENTION

A liquid supply device according to an embodiment of the present invention is described in detail below with reference to the drawings. The liquid supply device of the present invention is a device that supplies liquid discharged from a recording head to the recording head, and can be incorporated into an ink jet recording device in one embodiment.

(Liquid Supply Device)

Figure 1A:
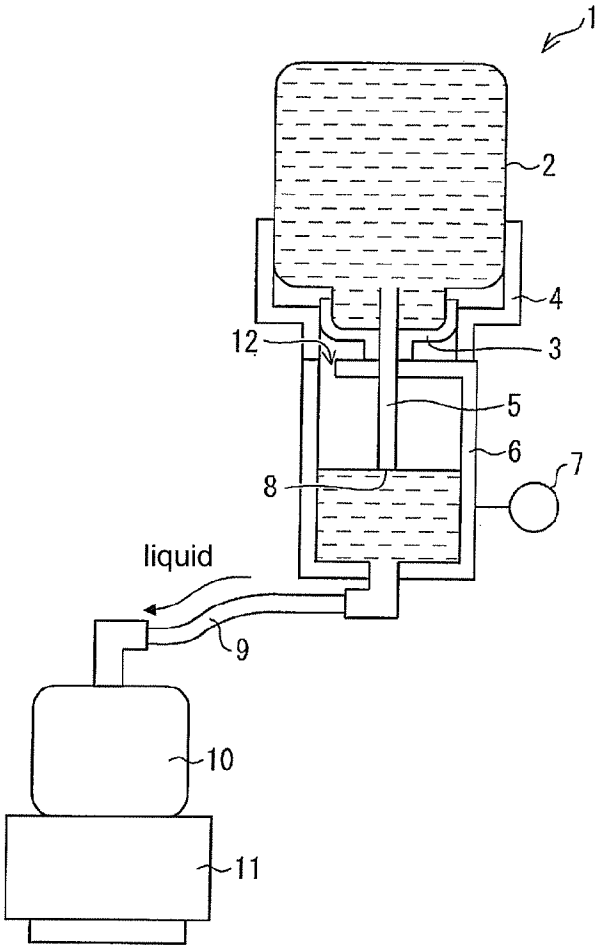
FIGS. 1A and 1B are pattern diagrams describing a schematic constitution and a schematic operation of a liquid supply device according to one embodiment of the present invention.
Figure 1B:
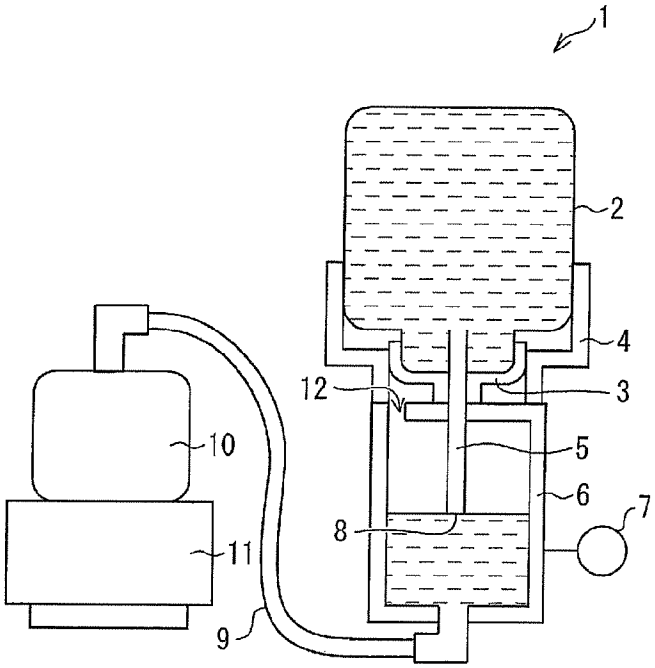

FIGS. 1A and 1B are diagrams describing a schematic constitution and a schematic operation of a liquid supply device 1 according to one embodiment of the present invention. As shown in FIGS. 1A and 1B, the liquid supply device 1 is a liquid supply device that supplies liquid to a recording head 11, and includes a main tank 2, a bottle cap 3, a fixing section 4, a pipe (supply pipe) 5, a sub tank 6, a driving section (driving unit) 7, an opening section (the first opening section) 8, a communication passage 9, and a pressure damper 10.

Typical liquid to be supplied to the recording head 11 by the liquid supply device 1 is ink.

The main tank 2 is a container for storing liquid to be discharged from the recording head 11. Liquid is supplied from the main tank 2 to the sub tank 6 via the pipe 5. The main tank 2 has airtightness so that liquid or gas does not enter or leave the main tank 2 via any route other than the pipe 5. It is preferable that the main tank 2 further has stiffness such that an inside of the container is not deformed by a negative pressure, and thus it can be constituted by polyethylene having stiffness, for example. As a result, the main tank 2 can be prevented from being deformed and discharge of liquid can be prevented. Further, the main tank 2 may be a large-capacity bottle that can be used in an industrial ink jet recording device that is expected to be continuously operated in one embodiment.

The pipe 5 is fixed to the bottle cap 3, and the bottle cap 3 is detachably fixed to the main tank 2. When the liquid in the main tank 2 is consumed by the operation of the liquid supply device 1, the main tank 2 is separated from the bottle cap 3, and only the main tank 2 is replaced with a new main tank 2, so that liquid can be replenished without moving the pipe 5. The main tank 2 and the bottle cap 3 are detachably fixed to the liquid supply device 1 by the fixing section 4.

The pipe 5 communicates the main tank 2 and the sub tank 6, thereby constituting a passage for supplying the liquid from the main tank 2 to the sub tank 6. The sub tank 6 is a container for temporarily storing the liquid supplied from the main tank 2, and further supplying the liquid to the recording head 11. The sub tank 6 has a ventilation opening 12, and the pipe 5 has the opening section (the first opening section) 8 on a position in the sub tank 6 lower than the ventilation opening 12 in a vertical direction.

The communication passage 9 communicates the sub tank 6 and the recording head 11, thereby supplying the liquid to the recording head 11. Further, the pressure damper 10 can be provided in a middle of the passage between the sub tank 6 and the recording head 11. It is preferable that a flexible tube is used as a material of the communication passage 9 because it is communicated with the sub tank 6 moved by the driving section 7.

The pressure damper 10 can absorb the pressure fluctuation in the liquid supplied from the sub tank 6 via the communication passage 9. As a result, liquid can be stably discharged from the recording head 11. Further, since the pressure damper 10 is provided, when a serial scanning method for scanning the recording head is employed, a carriage may be mounted with only the recording head 11 and the pressure damper 10. As a result, since an object to be driven by the scanning mechanism can be light-weighted, the scanning mechanism can be simplified so as to be provided at a moderate price.

The driving section 7 is communicated with the sub tank 6, and the height of the sub tank 6 can be adjusted in the vertical direction as shown in FIGS. 1A and 1B. As a result, a water head difference between the height of the liquid level in the sub tank 6 and the recording head 11 is adjusted, so that a supply pressure of liquid to be supplied from the sub tank 6 to the recording head 11 can be adjusted.

(Supply of Liquid from the Main Tank to the Sub Tank)

Figure 2A:
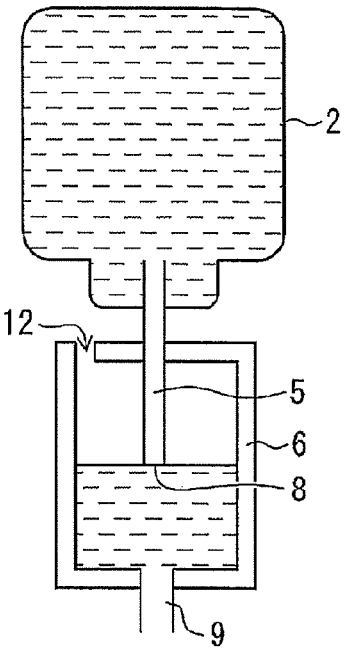
FIGS. 2A to 2D are pattern diagrams describing a mode of supply of liquid via a supply pipe in the liquid supply device according to one embodiment of the present invention.
Figure 2B:
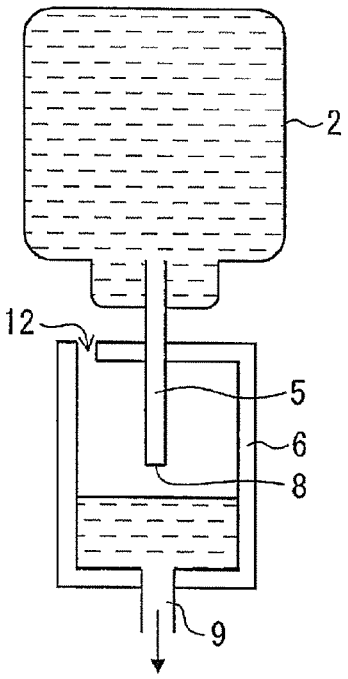
Figure 2C:
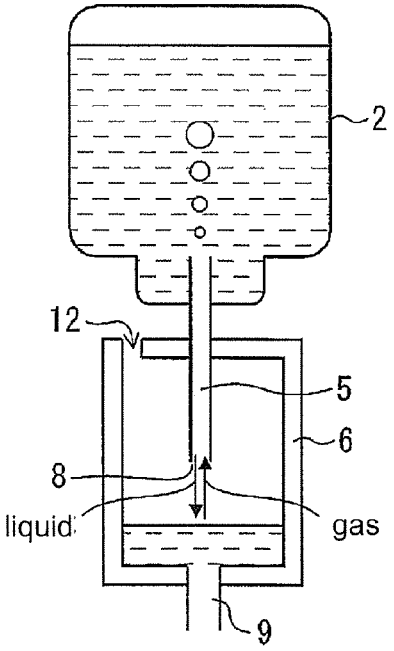
Figure 2D:
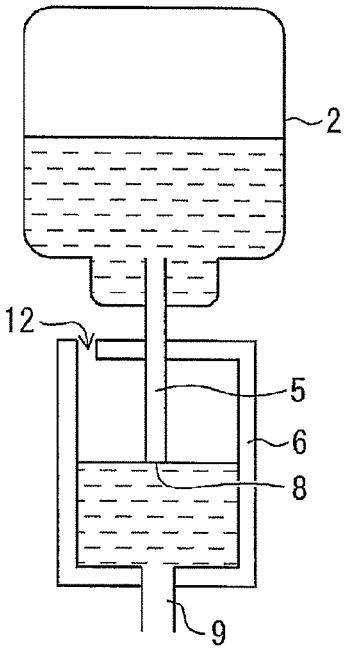

FIGS. 2A to 2D are diagrams describing a mechanism for supplying liquid from the main tank 2 to the sub tank 6. In the liquid supply device 1 according to this embodiment, the height of the liquid level in the sub tank 6 is kept at a height where the opening section (the first opening section) 8 is provided (FIG. 2A). When liquid is consumed by the recording head 11 due to print and liquid is reduced in the sub tank 6 (FIG. 2B), the opening section 8 is exposed to ambient air, and gas is introduced from the opening section 8 (FIG. 2C). The gas is introduced into the main tank 2 via the pipe 5, and instead liquid is supplied from the airtight main tank 2 to the sub tank 6 via the pipe 5 (FIG. 2C). Since external gas is introduced from the ventilation opening 12 also during the introduction of the gas from into the main tank 2 through the opening section 8, air pressure in the sub tank 6 is kept constant. When the liquid is supplied via the pipe 5, the height of the liquid level in the sub tank 6 is returned to the height of the opening section 8. When the opening section 8 is blocked by the liquid, the introduction of the gas into the main tank 2 is stopped, and the supply of liquid to the sub tank 6 is also stopped (FIG. 2D). Such a mechanism can keep the height of the liquid level in the sub tank 6 constant.

The employment of the above mechanism enables the liquid to be supplied from the main tank 2 to the sub tank 6 without providing a liquid level detector, a control device and a supply pump, and enables the height of the liquid level in the sub tank 6 to be kept constant. As a result, a complicated mechanism can be avoided, and a risk of a failure can be reduced.

(Supply of Liquid from the Sub Tank to the Recording Head)

The driving section 7, like FIGS. 1A and 1B, can adjust the height of the sub tank 6 in the vertical direction. Further, the above mechanism can keep the liquid level in the sub tank 6 constant. For this reason, the driving section 7 adjust a relative height of the recording head 11 and the sub tank 6 in the vertical direction, so that the water head difference between a nozzle of the recording head 11 and the liquid level in the sub tank 6 is adjusted, and the supply pressure of liquid can be easily adjusted. Further, since the liquid level in the sub tank 6 does not fluctuate due to the liquid consumption, the supply pressure of liquid can be suitably adjusted.

In a case of cleaning of the recording head 11 requiring a lot of liquid, as shown in FIG. 1B, the liquid level in the sub tank 6 is moved to a higher position than the recording head 11, and the supply pressure of liquid from the sub tank 6 to the recording head 11 is heightened. Further, as shown in FIG. 1A, the liquid level in the sub tank 6 is set on a position lower than the nozzle of the recording head 11, so that the liquid remaining on the recording head 11 can be recovered into the sub tank 6.

(Variation in the Pipe for Communicating the Main Tank and the Sub Tank)

The pipe that communicates the main tank 2 and the sub tank 6 may be, for example, the pipe 5 shown in FIGS. 1A and 1B, but may have another constitution.

Figure 3:
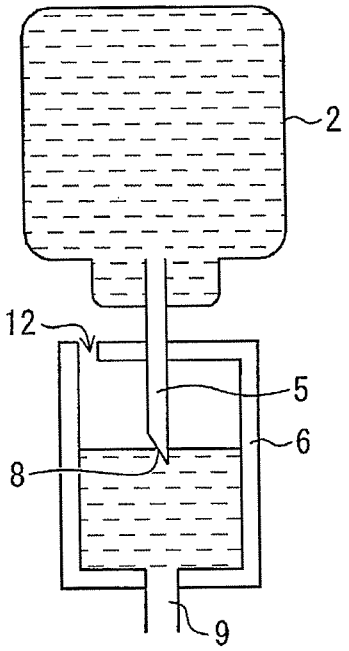
FIG. 3 is a pattern diagram illustrating a modified example of the supply pipe in the liquid supply device according to one embodiment of the present invention.

FIG. 3 is a diagram illustrating one modified example of the pipe 5. As shown in FIG. 3, the opening section (the first opening section) 8 of the pipe 5 in the sub tank 6 may be provided obliquely with respect to a horizontal surface. When the opening section 8 has such a constitution, air starts to be introduced into the main tank 2 from a higher position on the opening surface of the opening section 8 in the vertical direction. As a result, the passage into which gas is introduced is stable on the side surface opened on a higher position inside the pipe 5 in the vertical direction. On the contrary, the passage for supplying liquid is stable on the side surface opened on a lower position inside the pipe 5 in the vertical direction. Therefore, the side surface on the pipe 5 into which gas is introduced and the side surface to which liquid is supplied can be stabilized, and exchange between gas and liquid can be smoothly performed.

Further, in the state where the liquid level in the sub tank 6 is near the opening section 8, when the liquid level descends, an area of the opening section 8 opened for gas becomes gradually larger because the opening section 8 is provided obliquely with respect to the horizontal surface, and the amount of the liquid supplied to the sub tank 6 gradually increases. This prevents the area of the opening section 8 opened for air from being steeply large and prevents a large amount of liquid from being supplied at a time, so that the descending of the liquid level can be smoothly repressed.

Figure 4A:
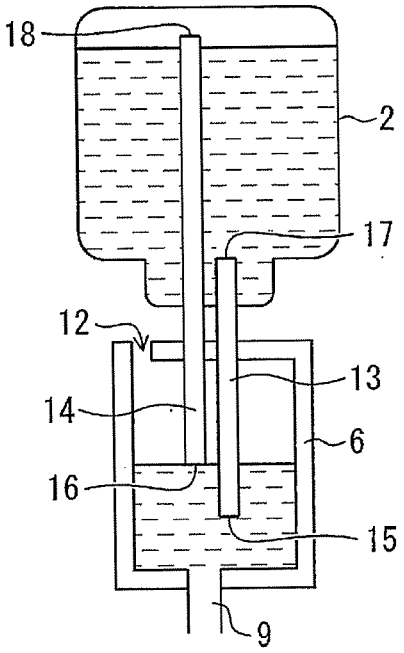
FIGS. 4A and 4B are pattern diagrams illustrating modified examples of the supply pipe in the liquid supply device according to one embodiment of the present invention.

Further, FIG. 4A is a pattern diagram illustrating a constitution where a pipe (the first pipe) 14 for introducing gas from the sub tank 6 into the main tank 2, and a pipe (second pipe) 13 for supplying liquid from the main tank 2 to the sub tank 6 are provided as the pipe for communicating the main tank 2 and the sub tank 6 instead of the pipe 5. As shown in FIG. 4A, the pipe 14 is provided with an opening section (third opening section) 18 inside the main tank 2, and an opening section (the first opening section) 16 in the sub tank 6, and the pipe (second pipe) 13 is provided with an opening section (second opening section) 17 in the main tank 2, and an opening section (fourth opening section) 15 in the sub tank 6. The opening section 18 is opened on a position higher than the opening section 17 in the vertical direction in the main tank 2, and the opening section 15 is opened on a lower position than the opening section 16 in the vertical direction in the sub tank 6.

At this time, when the liquid level in the sub tank 6 is lower than the opening section 16, gas enters the pipe 14 through the opening section 16, and the gas is introduced from the opening section 18 to the main tank 2 via the pipe 14. Accordingly, liquid is introduced from the main tank 2 into the pipe 13 through the opening section 17, and the liquid is supplied from the opening section 15 to the sub tank 6 via the pipe 13. When the liquid supplied from the opening section 15 allows the liquid level in the sub tank 6 to reach the height of the opening section 16, the introduction of the gas into the main tank 2 via the pipe 14 is stopped, and the supply of the liquid into the sub tank 6 via the pipe 13 is also stopped. As a result, the liquid level in the sub tank 6 is kept constant. In such a manner, in the constitution of FIG. 4A, particularly since the passage for introducing gas and the passage for supplying liquid are provided independently, liquid can be smoothly supplied from the main tank 2 to the sub tank 6. Further, when the opening section 18 for discharging gas is opened on the upper portion of the main tank 2, gas is introduced directly into the upper portion of the main tank 2 (portion where gas is retained), and thus the unnecessary dissolving of gas into the liquid in the main tank 2 can be repressed.

Figure 4B:
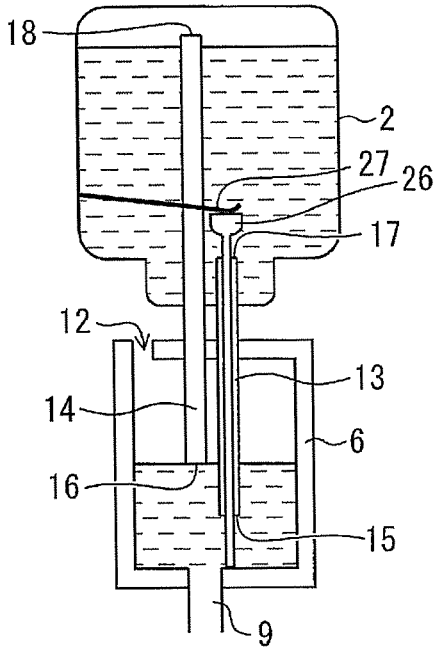

FIG. 4B is a pattern diagram illustrating a constitution where a leak prevention valve 26 is provided to the pipe 13 for supplying liquid from the main tank 2 to the sub tank 6 in the constitution of FIG. 4A. In order to attach the main tank 2 to the sub tank 6, when the opening section 15 of the pipe 13 of the main tank 2 is directed downward, the leak prevention valve 26 blocks the opening section 17 of the pipe 13 with flow of liquid in the pipe 13 and the own weight of the leak prevention valve 26. As a result, when the main tank 2 is attached to the sub tank 6, leak of liquid via the pipe 13 can be repressed to the minimum. Further, when the main tank 2 is attached to the sub tank 6, a leading end of the leak prevention valve 26 on the side of the opening section 15 touches a bottom portion inside the sub tank 6, so that a terminal end on the side of the opening section 17 is pushed up. For this reason, the blocked opening section 17 of the pipe 13 is opened. As a result, similarly to the constitution of FIG. 4A, liquid can be supplied from the main tank 2 to the sub tank 6 via the pipe 13.

Further, as shown in FIG. 4B, a biasing member 27 may bias the leak prevention valve 26 toward the opening section 17. The biasing member 27 can always maintain the opening section 17 in the blocked state even if the main tank 2 is in any posture, so that the leak of liquid can be prevented. Further, when the main tank 2 is attached to the sub tank 6, the leading end of the leak prevention valve 26 on the side of the opening section 15 touches the bottom portion inside the sub tank 6, so that the terminal end on the side of the opening section 17 is pushed up against the biasing member 27. For this reason, the blocked opening section 17 of the pipe 13 is opened. As a result, similarly to the constitution of FIG. 4A, liquid can be supplied from the main tank 2 to the sub tank 6 via the pipe 13.

Figure 5:
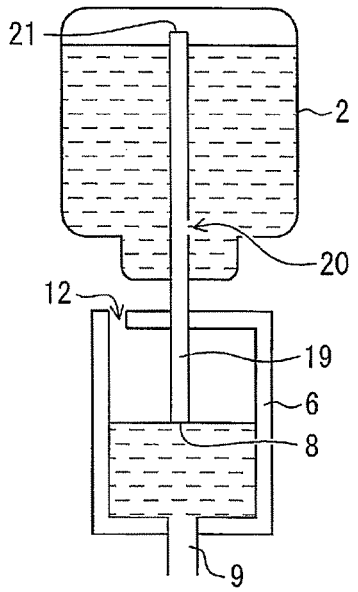
FIG. 5 is a pattern diagram illustrating a modified example of the supply pipe in the liquid supply device according to one embodiment of the present invention.

Further, FIG. 5 is a pattern diagram illustrating a constitution provided with a pipe (third pipe) 19, which has an opening section (third opening section) 20 and an opening section (second opening section) 21 in the main tank 2 and an opening section (the first opening section) 8 in the sub tank 6, as a pipe for communicating the main tank 2 and the sub tank 6 instead of the pipe 5. As shown in FIG. 5, the opening section 21 is provided on a higher position than the opening section 20 in the vertical direction, and the opening section 20 is provided on the side of the pipe 19.

At this time, when the liquid level in the sub tank 6 is lower than the opening section 8, gas enters the pipe 19 through the opening section 8, and the gas is not discharged from the opening section 20 provided to the side of the pipe 19 but introduced into the main tank 2 through the opening section 21. Accordingly, liquid is introduced from the main tank 2 into the pipe 19 through the opening section 20, and the liquid is supplied from the opening section 8 to the sub tank 6 via the pipe 19. When the liquid supplied from the opening section 8 allows the liquid level in the sub tank 6 to reach the height of the opening section 8, the introduction of the gas into the main tank 2 via the pipe 19 is stopped, and the supply of the liquid into the sub tank 6 via the pipe 19 is also stopped. As a result, the liquid level in the sub tank 6 is kept constant. In such a manner, in the constitution of FIG. 5, particularly since the opening section for discharging air and the opening section for allowing liquid to flow in are provided independently in the main tank 2, liquid can be smoothly supplied from the main tank 2 to the sub tank 6. Further, since the opening section 21 for discharging air is opened on the upper portion of the main tank 2, gas is introduced directly into the upper portion of the main tank 2 (portion where gas is retained), and thus the unnecessary dissolving of gas into the liquid in the main tank 2 can be repressed.

Figure 6:
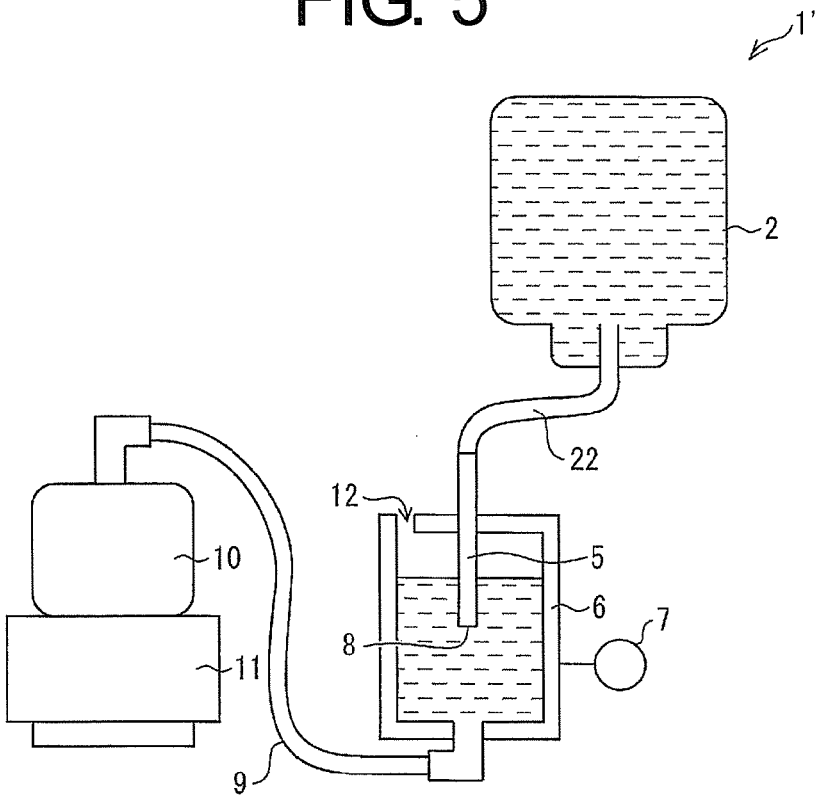
FIG. 6 is a pattern diagram describing a modified example of the liquid supply device according to one embodiment of the present invention.

Further, FIG. 6 is a pattern diagram describing a liquid supply device 1' in which the pipe for communicating the main tank 2 and the sub tank 6 is composed of the pipe 5 and a flexible section 22 having flexibility. As shown in FIG. 6, since at least a part of the pipe for communicating the main tank 2 and the sub tank 6 has flexibility, the driving section 7 can supply liquid from the sub tank 6 to the recording head 11 only by moving the sub tank 6. As a result, since the main tank 2 does not have to be moved, the liquid supply device 1' can be constituted compactly.

It is preferable that the flexible section 22 does not have a portion that is convex upward in a gravity direction (locally highest portion) so that air entering from the sub tank 6 of the flexible section 22 can reach the main tank 2 without retaining on the way. Concretely, by setting of a length and a thickness of the flexible section 22, and a guide member (not shown) for guiding the flexible section 22, the flexible section 22 is prevented from having the portion convex upward in the gravity direction even if the sub tank 6 is on any position. When the flexible section 22 has the portion convex upward in the gravity direction, air entering from the side of the sub tank 6 on the flexible section 22 retains, and the liquid supply from the main tank 2 to the sub tank 6 might be delayed, but the above constitution can prevent the retention of the air and can smoothen the liquid supply from the main tank 2 to the sub tank 6.

(In Regard to Cap of the Main Tank)

Figure 7A:
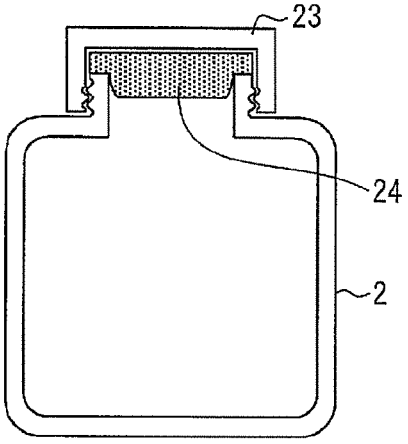
FIGS. 7A and 7D are pattern diagrams describing a bottle cap in the liquid supply device according to one embodiment of the present invention.

FIG. 7A is a pattern diagram describing the main tank 2 at a transportation time before it is attached to the liquid supply device 1. The main tank 2 is blocked by an inner lid 24, and the inner lid 24 is held down to be covered by a bottle cap 23, so that the main tank 2 can be transported with its inside being sealed.

Figure 7B:
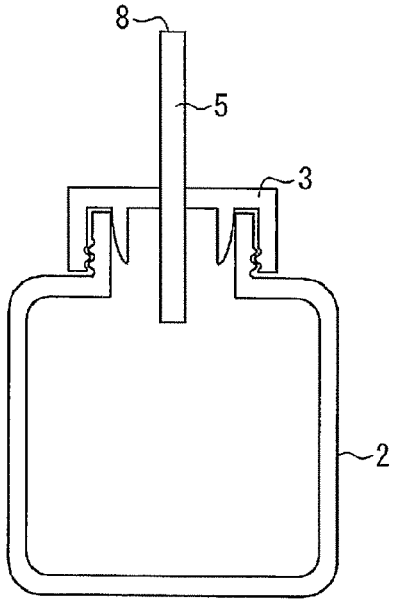

FIG. 7B illustrates a state where the bottle cap 23 and the inner lid 24 are removed, and the bottle cap 3 to which the pipe 5 is fixed is attached to the main tank 2. When the main tank 2 is attached to the liquid supply device 1, the bottle cap 23 and the inner lid 24 are replaced by the bottle cap 3 to which the pipe 5 is fixed. Since the main tank 2 has airtightness, even when the main tank 2 is turned upside down and the opening section 8 faces downward at the time of attaching the main tank 2 to the liquid supply device 1, the leak of liquid can be repressed to the minimum.

Figure 7C:
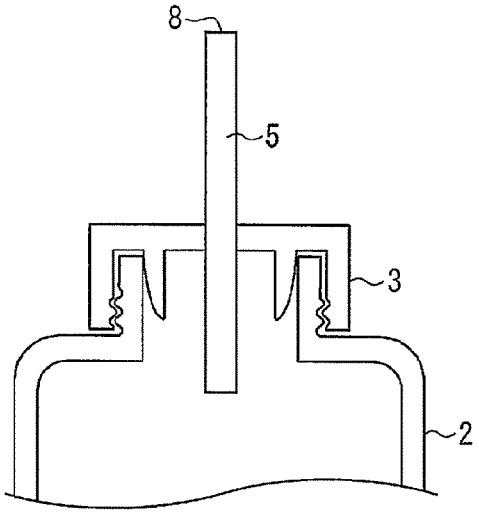
Figure 7D:
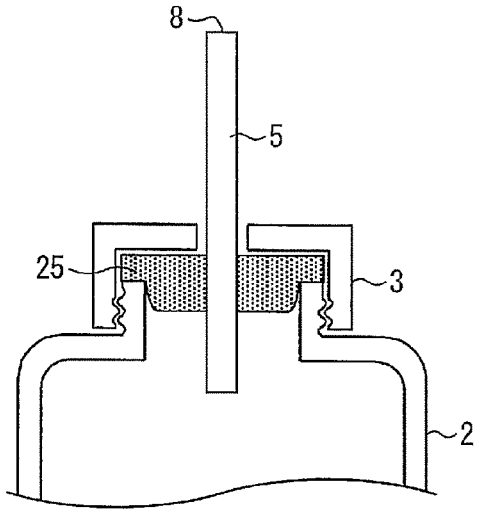

FIG. 7C is a pattern diagram illustrating one example of the bottle cap 3 to which the pipe 5 is fixed, and FIG. 7D is a pattern diagram illustrating a modified example of the bottle cap 3 to which the pipe 5 is fixed. The bottle cap 3 to which the pipe 5 is fixed may prevent liquid or gas from entering the main tank 2 via any way other than the pipe 5. As shown in FIG. 7C, the pipe 5 may be fixed to the bottle cap 3 having a function of an inner lid. Further, as shown in FIG. 7D, the pipe 5 may be attached to an inner lid 25 to be fixed by the bottle cap 3. The pipe 5, the inner lid 25, and the bottle cap 3 may be reused at the time of replacement of the main tank 2.

(In Regard to the Leak Prevention Valve)

The leak prevention valve and the biasing member may be provided not only to the pipe 13 shown in FIG. 4B, but also to the pipe 5 in FIGS. 2A to 2D, the pipe 5 in FIG. 3, and the pipe 19 in FIG. 5. Even when the leak prevention valve is provided to any of the pipes, similarly to the case of the pipe 13 in FIG. 4B, a liquid leak at the time when the main tank 2 is attached to the sub tank 6 can be repressed to the minimum.

Further, in one modified example, an end of the leak prevention valve on the side of the sub tank 6 may be bent into an L shape so as to be made to be larger than a diameter of the opening section 15 of the pipe 13. As a result, when the bottle cap to which the pipe 13 having the leak prevention valve is fixed is attached to the main tank 2, the leak prevention valve can be avoided from dropping out of the pipe 13.

(In Regard to Evaporation in the Sub Tank)

Typically, since a volatile component of a solvent included in ink is heavier than air, the component volatilized from liquid in the sub tank 6 is retained in the sub tank 6, and thus the sub tank 6 is filled with saturated vapor of the liquid even in atmospheric pressure. For this reason, excessive volatilization of liquid can be prevented in the sub tank 6.

On the other hand, in a case of ink using a lot of water, namely, so-called aqueous ink, since a volatile component of the ink is lighter than air, it is easily vaporized. For this reason, it is preferable that the ventilation opening 12 of the sub tank 6 is as small as possible. It is preferable that a diameter of the hole is 1 mm or less, and more preferably 0.5 mm or less.

Further, in one modified example, a degassing prevention member (so-called drop lid) for covering at least a part of the liquid level of the liquid that floats on the liquid stored in sub tank may further be provided in the sub tank 6. As a result, the vaporization of liquid stored in the sub tank can be prevented, and the state of the liquid can be maintained satisfactorily. The degassing prevention member can be composed of a plurality of balls (beads) as one example. Further, the degassing prevention member may be provided in the main tank 2.

The present invention is not limited to the above embodiments, and can be variously modified within the scope of claims, and thus embodiments obtained by suitably combining the technical units disclosed in the embodiment are also included in the technical field of the present invention.

<Supplementary>

The liquid supply device 1 according to this embodiment includes the main tank 2 for storing liquid to be discharged from the recording head 11, the pipe 5 that communicates with the main tank 2, a sub tank 6 for receiving liquid from the main tank 2 through a water head difference via the pipe 5 and storing the liquid, and a supply unit for supplying the liquid stored in the sub tank 6 to the recording head 11, the supply unit has the driving section 7 for adjusting the height of the sub tank 6 in the vertical direction, the sub tank 6 has the ventilation opening 12, and the pipe 5 has the opening section 8 opened at the predetermined height lower than the ventilation opening 12 in the vertical direction in the sub tank 6.

According to the above constitution, the pipe 5 supplies liquid to the sub tank 6 while introducing the gas to the main tank 2. When the liquid level of liquid reaches the opening section 8 in the sub tank 6, the opening section 8 is blocked by the liquid, and the introduction of gas is stopped. At the same time, the supply of the liquid to the main tank 2 is also stopped. Therefore, the liquid is stably supplied to the height of the opening section 8 in the sub tank 6. That is to say, the liquid is stored in the sub tank 6 so that height of the liquid level is kept constant. As a result, the driving unit 7 adjusts the height of the sub tank 6 in the vertical direction, thereby facilitating the adjustment of the water head difference between the sub tank 6 and the recording head 11. Therefore, the supply pressure of the liquid to the recording head 11 is easily adjusted, and the device can suitably respond to conditions in which a necessary amount of liquid is different, like a case of printing or cleaning of the recording head 11. Further, the liquid supply device 1 according to this embodiment does not have to have a liquid level detector or a supply pump, and thus simple, breakdown-resistant and inexpensive device can be provided.

In one modified example, the opening section 8 is provided obliquely with respect to the horizontal surface.

According to the above constitution, air starts to be introduced into the main tank 2 from a higher position on the opening surface of the opening section 8 in the vertical direction. As a result, the passage into which gas is introduced is stable on the side surface opened on a higher position inside the pipe 5 in the vertical direction. On the contrary, the passage for supplying liquid is stable on the side surface opened on a lower position inside the pipe 5 in the vertical direction. Therefore, the side surface on the pipe 5 into which gas is introduced and the side surface to which liquid is supplied can be stabilized, and exchange between gas and liquid can be smoothly performed.

Further, since the opening section 8 is provided obliquely, when the liquid level descends in the state where the liquid level is near the opening section 8, the area of the opening section 8 opened for gas becomes gradually larger because the opening section 8 is provided obliquely with respect to the horizontal surface, and the amount of the liquid supplied to the sub tank 6 gradually increases. This prevents the area of the opening section 8 opened for air from being steeply large and prevents a large amount of liquid from being supplied at a time, so that the descending of the liquid level can be smoothly repressed.

In one modified example, the supply pipe (the pipes 14 and 13) for communicating the main tank 2 and the sub tank 6 has the opening section 17 for allowing liquid to be supplied to the sub tank 6 to flow in, and the opening section 18 that is provided on the position higher than the opening section 17 in the vertical direction and discharges gas introduced from the sub tank 6 via the opening section 16 in the main tank 2. In another modified example, the supply pipe (the pipe 19) for communicating the main tank 2 and the sub tank 6 has the opening section 20 for allowing liquid to be supplied to the sub tank 6 to flow in, and the opening section 21 that is provided on the position higher than the opening section 20 in the vertical direction and discharges gas introduced from the sub tank 6 via the opening section 8 in the main tank 2.

According to the above constitution, the opening section 18 or 21 for discharging gas, and the opening section 17 or 20 for allowing liquid to flow in are provided independently in the main tank 2, so that the liquid can be smoothly supplied from the main tank 2 to the sub tank 6. Further, when the opening section 18 or 21 for discharging gas is opened on the upper portion of the main tank 2, gas is introduced directly into the upper portion of the main tank 2 (portion where gas is retained), and the unnecessary dissolving of gas into the liquid in the main tank 2 can be repressed.

In one modified example, the supply pipe for communicating the main tank 2 and the sub tank 6 is provided with the pipe 14 for supplying gas from the sub tank 6 to the main tank 2, and the pipe 13 for introducing liquid from the main tank 2 to the sub tank 6, the pipe 14 is provided with the opening section 16 and the opening section 18, and the pipe 13 is provided with the opening section 17 and the opening section 15 that is opened on the position lower than the opening section 16 in the vertical direction in the sub tank 6.

According to the above constitution, the passage for introducing gas and the passage for supplying liquid are provided independently. As a result, liquid can be smoothly supplied from the main tank 2 to the sub tank 6.

In one modified example, the supply pipe for communicating the main tank 2 and the sub tank 6 has the pipe 19 for communicating the opening section 8 and the opening section 21, and the opening section 20 is provided to the side surface of the pipe 19.

According to the above constitution, the supply pipe can be preferably constituted.

In the liquid supply device 1, the supply unit is provided with the communication passage 9 for communicating the sub tank 6 and the recording head 11, and the pressure damper 10 that is provided on the communication passage 9 and reduces a fluctuation in the pressure of the liquid flowing through the communication passage 9.

According to the above constitution, the supply pressure of liquid from the sub tank 6 to the recording head 11 can be adjusted more suitably by the pressure damper 10. Therefore, a discharge amount of liquid upon printing can be suitably adjusted.

In one modified example, in the liquid supply device 1', at least a part of the supply pipe (the pipe 5 and the flexible section 22) for communicating the main tank 2 and the sub tank 6 has flexibility, and adjusts the height of the sub tank 6 in the vertical direction without moving the driving section 7 and the main tank 2.

According to the above constitution, since the height of the liquid level in the sub tank 6 is kept constant, only the sub tank 6 is moved so that the supply pressure of liquid can be adjusted. This can make the liquid supply device 1' a more compact constitution.

The ink jet recording device according to this embodiment has the liquid supply device 1 as described above.

According to the above constitution, in the ink jet device that can adjust the supply pressure of liquid to the recording head 11, a fluctuation in the supply pressure of liquid caused by liquid consumption on the recording head 11 can be repressed in the simple constitution.

A liquid supply method according to this embodiment in the liquid supply device 1 including the main tank 2 for storing liquid to be discharged from the recording head 11, the pipe 5 communicated with the main tank 2, and the sub tank 6 having the ventilation opening 12, the pipe 5 having the opening section 8 opened at a predetermined height lower than the ventilation opening 12 in the vertical direction in the sub tank 6, includes a step of supplying liquid from the main tank 2 via the pipe 5 according to the water head difference and storing the liquid in the sub tank 6 so that the liquid level is at the predetermined height, and a step of supplying the liquid stored in the sub tank 6 to the recording head 11 by adjusting the height of the sub tank 6 in the vertical direction.

The above method produces the effect equivalent to that of the liquid supply device 1 according to this embodiment.

Industrial Applicability

The present invention can be used for the liquid supply device in the ink jet recording device.

Description of Reference Signs

1: Liquid supply device
2: Main tank
3: Bottle cap
4: Fixing section
5: Pipe (supply pipe)
6: Sub tank
7: Driving section (driving unit)
8: Opening section (first opening section)
9: Communication passage
10: Pressure damper
11: Recording head
12: Ventilation opening
13: Pipe (second pipe, supply pipe)
14: Pipe (first pipe, supply pipe)
15: Opening section (fourth opening section)
16: Opening section (the first opening section)
17: Opening section (second opening section)
18: Opening section (third opening section)
19: Pipe (third pipe, supply pipe)
20: Opening section (second opening section)
21: Opening section (third opening section)
22: Flexible section (supply pipe)
23: Bottle cap (for transportation)
24: Inner lid
25: Inner lid (for attachment of pipe)
26: Leak prevention valve
27: Biasing member

The invention claimed is:

1. An ink jet recording device comprising:
a main tank for storing a liquid;
a supply pipe communicated with the main tank;
a sub tank for receiving the liquid from the main tank via the supply pipe according to a water head difference and storing the liquid;
a recording head for discharging the liquid; and
a supply unit for supplying the liquid stored in the sub tank to the recording head, wherein the supply unit has a driving unit for adjusting a height of the sub tank in a vertical direction, and a communication passage communicating the sub tank and the recording head to supply the liquid stored in the sub tank to the recording head, the sub tank has a ventilation opening in which a gas phase part connects to ambient air, the supply pipe has a first opening section opened at a predetermined height lower than the ventilation opening in the sub tank in the vertical direction, the sub tank is configured such that when the liquid is consumed by the recording head and the liquid is reduced, the first opening section is exposed to the gas phase part and a gas in the gas phase part is introduced from the first opening section into the main tank via the supply pipe, so that a height of a liquid level of the liquid in the vertical direction of the sub tank is maintained at the height in the vertical direction where the first opening section is disposed, and a water head difference between the liquid in the sub tank and the recording head is adjusted by adjusting the height of the sub tank in the vertical direction through the driving unit.

2. The ink jet recording device according to claim 1, wherein the first opening section is provided obliquely with respect to a horizontal surface.

3. The ink jet recording device according to claim 2, wherein the supply pipe has, in the main tank, a second opening section for allowing liquid to be supplied to the sub tank to flow in, and a third opening section for discharging ambient air introduced from the sub tank via the first opening section, the third opening provided on a position higher than the second opening section in the vertical direction.

4. The ink jet recording device according to claim 1, wherein the supply pipe has, in the main tank, a second opening section for allowing liquid to be supplied to the sub tank to flow in, and a third opening section for discharging the ambient air introduced from the sub tank via the first opening section, the third opening provided on a position higher than the second opening section in the vertical direction.

5. The ink jet recording device according to claim 4, wherein the supply pipe includes a first pipe for introducing the ambient air from the sub tank into the main tank, and a second pipe for supplying liquid from the main tank to the sub tank, the first pipe is provided with the first opening section and the third opening section, and the second pipe is provided with the second opening section and a fourth opening section opened on a lower position than the first opening section in the vertical direction in the sub tank.

6. The ink jet recording device according to claim 4, wherein the supply pipe has a third pipe for communicating the first opening section and the third opening section, and the second opening section is provided to a side surface of the third pipe.

7. The ink jet recording device according to claim 1, wherein the supply unit has a pressure damper for reducing a pressure fluctuation of liquid flowing through the communication passage.

8. The ink jet recording device according to claim 1, wherein at least a part of the supply pipe has flexibility, and the driving unit adjusts the height of the sub tank in the vertical direction without moving the main tank.

9. A liquid supply method in an ink jet recording device including a main tank for storing a liquid to be discharged from a recording head, a supply pipe communicated with the main tank, a sub tank having a ventilation opening to ambient air, and a recording head for discharging the liquid, the supply pipe having an opening section opened at a predetermined height lower than the ventilation opening in a vertical direction in the sub tank, the method comprising:

a step of supplying the liquid to the sub tank such that a liquid level in the sub tank is at the predetermined height by supplying the liquid from the main tank through introducing the ambient air from the first opening section to the main tank via the supply pipe when the liquid is consumed by the recording head via the supply pipe and the liquid is reduced to expose the first opening section to the ambient air; and a step of adjusting a water head difference between a height of a liquid level of the liquid stored in the sub tank and the recording head by adjusting a height of the sub tank in the vertical direction.

* * * * *